US005794579A

United States Patent [19]

Moriya

[11] Patent Number: 5,794,579

[45] Date of Patent: Aug. 18, 1998

[54] VARIABLE VALVE TIMING MECHANISM OF ENGINE

[75] Inventor: Yoshihito Moriya, Nagoya, Japan

[73] Assignee: Toyota Jidosha Kabushiki Kaisha, Toyota, Japan

[21] Appl. No.: 961,220

[22] Filed: Oct. 30, 1997

Related U.S. Application Data

[62] Division of Ser. No. 832,889, Apr. 4, 1997.

[30] Foreign Application Priority Data

Apr. 8, 1996 [JP] Japan ..... 8-85043

[51] Int. Cl.[6] ..... F01L 1/344

[52] U.S. Cl. ..... 123/90.17; 123/90.31; 123/90.34

[58] Field of Search ..... 123/90.15, 90.17, 123/90.31, 90.34; 74/567, 568 R; 464/1, 2, 160, 161

[56] References Cited

U.S. PATENT DOCUMENTS

| | | | |
|---|---|---|---|
| 5,144,921 | 9/1992 | Clos et al. | 123/90.17 |
| 5,170,756 | 12/1992 | Szobfridt | 123/90.15 |
| 5,203,290 | 4/1993 | Tsuruta et al. | 123/90.17 |
| 5,209,193 | 5/1993 | Uchida et al. | 123/90.17 |
| 5,345,898 | 9/1994 | Krebs | 123/90.17 |
| 5,435,782 | 7/1995 | Tortul | 123/90.17 |
| 5,483,930 | 1/1996 | Moriya et al. | 123/90.17 |
| 5,503,121 | 4/1996 | Speil et al. | 123/90.34 |
| 5,540,197 | 7/1996 | Golovatai-Schmidt et al. | 123/90.17 |
| 5,566,651 | 10/1996 | Strauss et al. | 123/90.17 |
| 5,626,108 | 5/1997 | Kato et al. | 123/90.17 |

FOREIGN PATENT DOCUMENTS

| | | |
|---|---|---|
| 2 680 543 | 2/1993 | France . |
| 195 02 496 | 8/1996 | Germany . |
| 6-330712 | 11/1994 | Japan . |

*Primary Examiner*—Weilun Lo
*Attorney, Agent, or Firm*—Kenyon & Kenyon

[57] ABSTRACT

A Variable Valve timing mechanism is provided at the distal end of a camshaft for changing a valve timing of an engine valve. A camshaft is rotatably supported by a cylinder head and bearing cap, which form a baring. A pulley is mounted on the camshaft, and is relatively rotatably with respect to the camshaft. A belt connects the pulley to a crankshaft to transmit power from an engine to the pulley. The belt applies tension to the pulley and the camshaft in a specific direction. A ring gear is positioned between the camshaft and the pulley. First and second hydraulic pressure chambers are defined at the ends of the ring gear. A first oil passage is defined in the camshaft and is connected to the first pressure chamber. A second oil passage is defined in the camshaft, and is connected to the second pressure chamber. A pair of grooves extend along the inner circumference of the cylinder head. The grooves do not extend into a non-load bearing portion of the bearing.

4 Claims, 5 Drawing Sheets

VARIABLE VALVE TIMING MECHANISM OF ENGINE

This is a division of application Ser. No. 08/832,889 filed Apr. 4, 1997.

BACKGROUND OF THE INVENTION

1. FIELD OF THE INVENTION

The present invention relates to a variable valve timing mechanism provided in an engine to change the valve timing of intake valves or exhaust valves. More particularly, the present invention pertains to a variable valve timing mechanism that is driven by fluid pressure.

2. DESCRIPTION OF THE RELATED ART

A variable valve timing mechanism (hereafter referred to as VVT) is provided in an engine to displace the rotational phase of a camshaft and adjust the valve timing of either an intake valve or an exhaust valve. The operation of the VVT optimizes the valve timing in accordance with the operating state of the engine (engine load, engine speed, and other factors). This improves fuel economy, increases engine power, and suppresses undesirable engine emissions regardless of different operating states of the engine. U.S. Pat. No. 5,483,930, which is incorporated herein by reference, describes a typical VVT.

The type of VVT described in the above patent is shown in FIG. 8. As shown in the drawing, a VVT 71 includes a valve train 72 that is driven by hydraulic power.

As shown in FIG. 8, a journal 74 of a camshaft 73 is rotatably supported by a cylinder head 75 and a bearing cap 76. The camshaft 73 drives intake valves (not shown). The camshaft 73 is provided with a first oil groove 77 and a second oil groove 78 that extend circumferentially in the outer surface of the journal 74. Oil is supplied to the first oil groove 77 through a first oil passage 88 and to the second oil groove 78 through a second oil passage 89. The cross-sectional area and width of the two oil grooves 77, 78 are the same. Each oil groove 77, 78 is sealed by the contact between the journal 74 and the inner surfaces of the bearing cap 76 and the cylinder head 75.

A pulley 80 is fit on the camshaft 73 and supported in a manner allowing relative rotation between the pulley 80 and the camshaft 73. A pulley 81*a* is fixed to the crankshaft 81. A belt 82 is wound about the pulleys 80, 81*a* to connect the crankshaft 81 and the camshaft 73. A cover 83 is fixed to the pulley 80 to cover one side of the pulley 80 and the distal end of the camshaft 73.

An inner gear 84 is fastened to the distal end of the camshaft 73 by a bolt 73*a*. A ring gear 85 is arranged between the cover 83 and the inner gear 84. The ring gear 85 rotates relative to the cover 83 and the inner gear 84.

In the cover 83, a first hydraulic pressure chamber 86 is defined at the left side of the ring gear 85 and a second hydraulic pressure chamber 87 is defined at the right side of the ring gear 85, as viewed in the drawing. An oil passage 88, which extends through the camshaft 73, and an oil passage 73*b*, which extends through the bolt 73*a*, connect the first oil groove 77 to the first pressure chamber 86. An oil passage 89 connects the second oil groove 78 to the second pressure chamber 87.

The rotation of the crankshaft 81 is transmitted to the pulley 80 by means of the pulley 81*a* and the belt 82. The rotation of the pulley 80 is transmitted to the inner gear 84 and the camshaft 73 by means of the cover 83 and the ring gear 85.

Hydraulic pressure is conveyed to the pressure chambers 86, 87 through the associated oil passages 88, 89 and applied to the end faces of the ring gear 85. When rotated, the ring gear 85 moves to the left or to the right along the axial direction of the camshaft 73 in accordance with the difference between the pressures applied to the end faces of the gear 85. This displaced the rotational phase of the camshaft 73 with respect to the pulley 80. The valve timing of the intake valve is adjusted by the rotational phase displacement of the camshaft 73.

The tension of the belt 82 results in the camshaft 73 receiving load that is directed toward the crankshaft 81. Thus, the journal 74 of the camshaft 73 is pressed against the cylinder head 75. This produces a small clearance C between the journal 74 and the bearing cap 76 (the dimension of the clearance C is exaggerated in FIG. 7). The clearance C allows the oil supplied to the oil grooves 77, 78 to be applied thoroughly to the journal 74. This enables smooth rotation of the journal 74.

When the dimension of clearance C becomes excessively large, the sealing of the oil grooves 77, 78 becomes insufficient. As a result, an undesirable amount of oil may leak out of the oil grooves 77, 78. This may lower the hydraulic pressure conveyed to the hydraulic pressure chambers 86, 87 and cause the hydraulic pressure to become insufficient. In addition, insufficient sealing between the oil grooves 77, 78 may cause a portion of the oil supplied to the first pressure chamber 86 to enter the second pressure chamber 87 through the clearance C. Furthermore, a portion of the oil supplied to the second pressure chamber 87 may enter the first pressure chamber 86 through the clearance C. This may cause the hydraulic pressures conveyed to the hydraulic pressure chambers 86, 87 to affect each other. This degrades the responsiveness of the VVT 71. The amount of oil that leaks from the oil grooves 77, 78 is proportional to the cube of the width of the clearance C and is inversely proportional to the length of the surface that is to be sealed (sealed surface 79). The dimension of the clearance C may be minimized to reduce the amount of oil leakage. However, the dimension of the clearance C is greatly affected by machining accuracy. Furthermore, the oil grooves 77, 78 require a certain cross-sectional area to supply a sufficient amount of oil therethrough. Thus, to prevent excessive leakage of oil, the length of the journal 74 may be extended to increase the area of the sealed surface 79 and increase the distance between the oil grooves 77, 78.

However, extending the length of the journal 74 to provide a larger sealed surface 79 leads to a longer camshaft 73. This is undesirable since the size of the engine (not shown) is thus lengthened.

SUMMARY OF THE INVENTION

Accordingly, it is an objective of the present invention to provide a variable valve timing mechanism having improved sealing between a journal and a bearing and having improved responsiveness. The variable valve timing mechanism is driven by fluid pressure that is conveyed to an area between the journal of a camshaft and a bearing supporting the camshaft.

To achieve the above objective, apparatus includes a crankshaft, a camshaft for actuating the valve, a journal bearing for rotatably supporting the camshaft, the bearing having an inner cylindrical surface, a rotor mounted on the camshaft, the rotor being rotatable relative to the camshaft, a transmission means for connecting the rotor to the the crankshaft to transmit power from the engine to the rotor, wherein the transmission means applies a force to the rotor and the camshaft in a specific direction, and wherein, as a result of a net force on the camshaft, a portion of the cylindrical surface is load bearing and an opposite portion of the cylindrical surface is non-load bearing, an actuating member for changing the relative rotational relationship between the camshaft and the rotor, a first pressure chamber for applying a hydraulic fluid pressure to the actuating member to move the actuating member in a first direction, a second pressure chamber for applying a hydraulic fluid pressure to the actuating member to move the actuating member in a second direction, a first passage defined in the camshaft, the first passage being connected to the first pressure chamber, a second passage defined in the camshaft, the second passage being connected to the second pressure chamber, a first groove formed circumferentially in the inner cylindrical surface of the bearing, the first groove being connected to the first passage, wherein the first groove has a portion located in the load bearing portion of the cylindrical surface and a portion located in the non-load bearing portion of the cylindrical surface, and a second groove formed circumferentially in the inner cylindrical surface of the bearing, the second groove being connected to the second passage, wherein the second groove has a portion located in the load bearing portion of the cylindrical surface and a portion located in the non-bearing portion of the cylindrical surface, and wherein the first and second grooves are wider in the load bearing portion of the cylindrical surface than in the non-load bearing portion of the cylindrical surface.

In another embodiment, the grooves do not extend into a non-load gearing portion of the journal.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

First Embodiment

A first embodiment of a variable valve timing mechanism (hereafter referred to a VVT) according to the present invention will now be described with reference to FIGS. 1 to 4.

Figure 4:
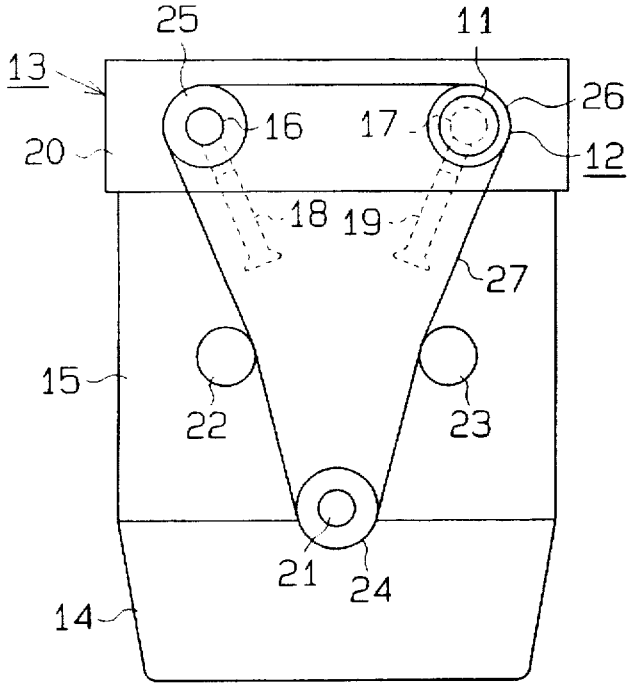
FIG. 4 is a diagrammatic front view showing an engine provided with the variable valve timing mechanism of FIG. 1.

An engine 13 having a valve train 12 that includes a VVT 11 is shown in FIG. 4. The engine 13 includes an oil pan 14 for reserving lubricating oil, a cylinder block 15 provided with cylinders (not shown), and a cylinder head 20. The cylinder head 20 supports camshafts 16, 17, exhaust valves 18, and intake valves 19.

The cylinder block 15 rotatably supports a crankshaft 21. Tensioners 22, 23 are arranged at predetermined positions on the cylinder block 15. The cylinder head 20 rotatably supports the camshaft 16 so as to open and close the exhaust valves 18. The cylinder head 20 also rotatably supports the camshaft 17 so as to open and close the intake valves 19. The VVT 11 is provided at a distal end of the camshaft 17. Pulleys 24, 25, 26 are provided at distal ends of the crankshaft 21, the camshaft 16, and the VVT 11, respectively. A belt 27 is wound about the pulleys 24, 25, 26. Tension is applied to the wound belt 27 by the tensioners 22, 23. The tension is directed to pull the pulleys 24, 25, 26 toward one another. This prevents the belt 27 from falling off the pulleys 24, 25, 26. The tension also prevents the belt 27 from sliding with respect to the pulleys 24, 25, 26.

The rotation of the crankshaft 21 is transmitted to the camshafts 16, 17 by means of the belt 27 and the pulleys 24, 25, 26. This rotates the camshafts 16, 17 synchronously with the crankshaft 21. The rotation of the camshafts 16, 17 selectively opens and closes the associated exhaust and intake valves 18, 19 in accordance with a predetermined timing.

Figure 1:
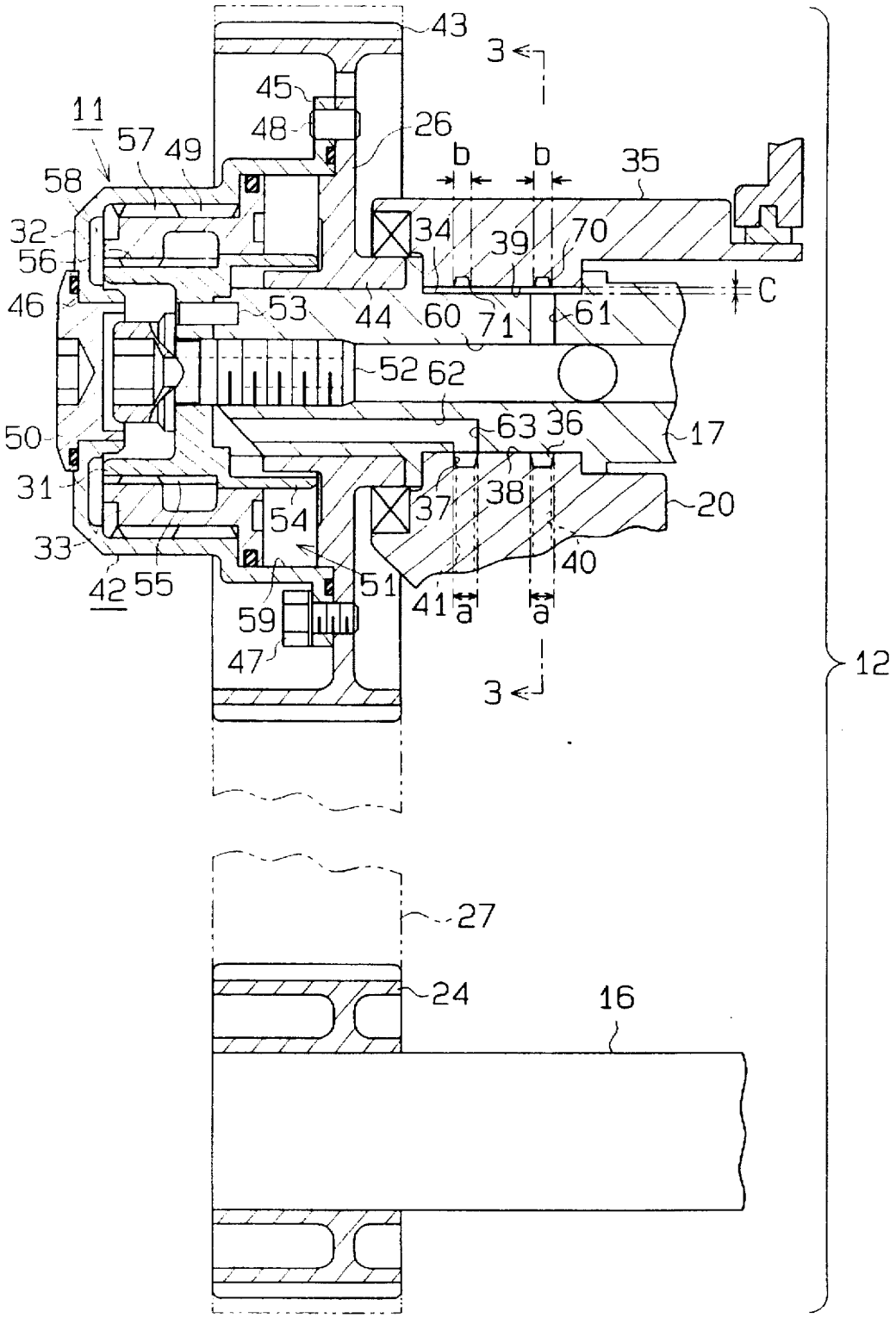
FIG. 1 is a cross-sectional view showing a first embodiment of a variable valve timing mechanism according to the present invention.

FIG. 1 partially shows the valve train 12 that is provided with the VVT 11. The VVT 11 includes the pulley 26 serving as a rotor, a cover 32 fastened to the pulley 26, and a ring gear 33 located between the cover 32 and the camshaft 17. The ring gear 33 serves as an actuating member for the VVT.

The camshaft 17 has a journal 34 that is rotatably supported between the cylinder head 20 and a bearing cap 35. The cylinder head 20 encompasses the lower half of the journal 34 while the bearing cap 34 encompasses the upper half of the journal 34. A first oil groove 36, and a second oil groove 37 are provided in the inner cylindrical surface of the cylinder head 20. A third oil groove 70 and a fourth oil groove 71 are provided in the inner cylindrical surface of the bearing cap 35. Each oil groove 36, 37, 70, 71 extends in the circumferentially in the journal 34. The first and third grooves 36, 70 are connected with each other and define an annular groove about the journal 34. The second and fourth grooves 37, 71 are connected with each other and define an annular groove about the journal 34. The first and second grooves 36, 37 are sealed by the contact between the inner surface of the cylinder head 20 and the outer surface of the journal 34. The inner surface of the cylinder head 20 that contacts the journal 34 and lies between the first and second oil grooves 36, 37 is defined as the sealed surface 38. The third and fourth oil grooves 70, 71 are sealed by the contact between the inner surface of the bearing cap 35 and the outer surface of the journal 34. The inner surface of the bearing cap 35 that contacts the journal 34 and lies between the third and fourth oil grooves 70, 71 is defined as the sealed surface 39. The width a of the first and second oil grooves 36, 37 is greater than the width b of the third and fourth oil grooves 70, 71. Additionally, the width a of the oil grooves 36, 37 is greater than that of the prior art oil grooves, while the width b of the oil grooves 70, 71 is smaller than that of the prior art oil grooves. Furthermore, the distance between the third oil groove 70 and the fourth oil groove 71 is greater than the distance between the first oil groove 36 and the second oil groove 37. Oil conduits 40, 41 that extend through the cylinder head 20 are connected with the first and second oil grooves 36, 37, respectively.

The pulley 26, which has a substantially disc-like shape, is fitted to the camshaft 17 in a manner allowing relative rotation with respect to the camshaft 17. The pulley 26 has a plurality of outer teeth 43 projecting from its peripheral surface and a boss 44 defined at the center of the pulley 26. The outer teeth 43 of the pulley 26 mesh with the belt 27.

The cover 32, which has a cup-like shape, includes a flange 45 that extends about the periphery of the cover 32. A plurality of bolts 47 and pins 48 fasten the flange 45, or the cover 32, to the pulley 26. The cover 32 has a plurality of inner teeth 49 and an opening 46. The opening 46 is closed by a removable lid 50. The pulley 26 and the cover 32 constitute a housing 42 provided with a space 51 defined therein.

A cylindrical inner gear 31 is fastened to the distal end of the camshaft 17 by a hollow bolt 52 and a pin 53. The inner gear 31 has a peripheral wall 54 that encompasses the boss 44 of the pulley 26. The inner gear 31 and the pulley 26 are rotatable with respect to each other. A plurality of outer teeth 55 project from the peripheral wall 54. The inner teeth 49 of the cover 32 and the outer teeth 55 of the inner gear 31 are helical splines that are engaged with each other.

The ring gear 33 is arranged between the inner gear 31 and the cover 32. Thus, the ring gear 33 connects the inner gear 31 to the cover 32. Inner teeth 56 project from the inner circumferential surface of the ring gear 33 while outer teeth 57 project from the outer circumferential surface of the ring gear 33. The teeth 56, 57 are helical splines. The inner teeth 56 are meshed with the outer teeth 55 of the inner gear 31, while the outer teeth 57 are meshed with the inner teeth 49 of the cover 32. The ring gear 33 is movable in the axial direction of the camshaft 17. When moved axially, the helical splines rotate the ring gear 33 relatively to the camshaft 17. Thus, the ring gear 33 enables the camshaft 17 to rotate integrally with the pulley 26.

In the cover 32, a first hydraulic pressure chamber 58 is defined on one side of the ring gear 33 while a second hydraulic pressure chamber 59 is defined on the other side of the ring gear 33.

A first oil passage 60 is provided in the camshaft 17 to communicate hydraulic pressure to the first pressure chamber 58. The first oil passage 60 extends in the axial direction of the camshaft 17. The distal end of the first oil passage 60 is connected to the first pressure chamber 58 through the hollow portion of the bolt 52. The basal end of the first oil passage 60 is selectively connected to the first oil groove 36 and the third oil groove 70 by way of a first oil hole 61, which extends radially through the camshaft 17.

A second oil passage 62, which extends parallel to the first oil passage 60, is provided in the camshaft 17 to communicate hydraulic pressure to the second pressure chamber 59. The distal end of the second oil passage 62 is connected to the second pressure chamber 59. The basal end of the second oil passage 62 is selectively connected to the second oil groove 37 and the fourth oil groove 71 by way of a second oil hole 63, which extends radially through the camshaft 17.

Hydraulic pressure produced by a hydraulic pressure control apparatus (not shown) is communicated to the pressure chambers 58, 59 through the oil passages 60, 62.

Figure 2:
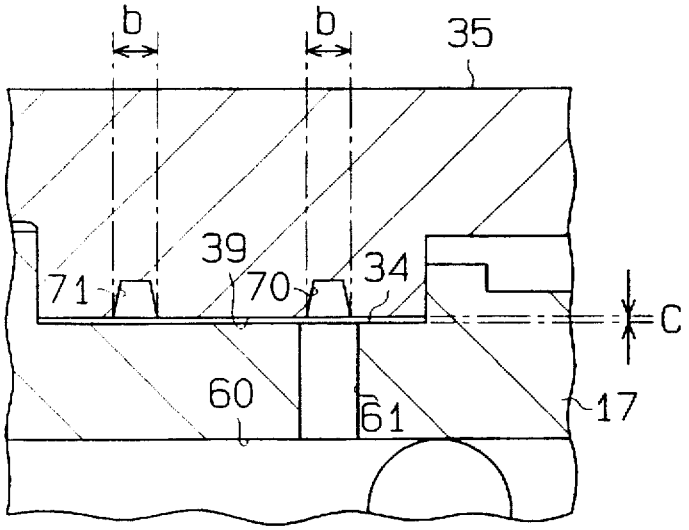
FIG. 2 is a partial enlarged cross-sectional view of a portion of FIG. 1.
Figure 3:
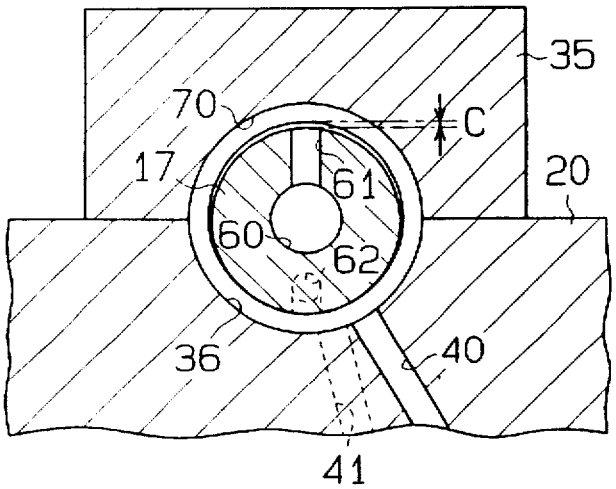
FIG. 3 is a partial cross-sectional view taken along line 3—3 in FIG. 1.

Tension applied to the belt 27 constantly pulls the pulley 26 and the camshaft 17 toward the crankshaft 21. The tension causes the camshaft 17 to receive load that is oriented in a generally downward direction. This presses the journal 34 against the sealed surface 38. As a result, a slight clearance C exists between the camshaft 17 and the sealed surface 39 of the bearing cap 35 (FIGS. 1 to 3). The width of clearance C is shown in an exaggerated manner in the drawings.

The first pressure chamber 58 receives hydraulic fluid that is conveyed by way of the oil conduit 40, the first oil groove 36, the third oil groove 70, the first oil hole 61, and the first oil passage 60. The second pressure chamber 59 receives hydraulic fluid that is conveyed by way of the oil conduit 41, the second oil groove 37, the fourth oil groove 71, the second oil hole 63, and the second oil passage 62. The hydraulic fluid conveyed to each pressure chamber 58, 59 acts on each side of the ring gear 33. As a result, the ring gear 33 is rotated and moved toward the right and toward the left, as viewed in FIG. 1, relatively to the inner gear 31 and the pulley 26. This displaces the rotational phase of the camshaft 17 with respect to the pulley 26 and adjusts the valve timing of the intake valve 18 (FIG. 4). In this embodiment, the hydraulic pressure in each pressure chamber 58, 59 is controlled to adjust the position of the ring gear 33. The hydraulic pressure in the pressure chambers 58, 59 is then balanced to maintain the ring gear 33 at a given position located within the moving stroke of the gear 33. Thus, the valve timing of the intake valve 19 may be varied continuously. The valve timing of the intake valve 19 may be varied between two stages or between a multiple number of stages by conveying hydraulic fluid to the pressure chambers 58, 59 in a selective manner.

In this embodiment, the journal 34 is pressed against the sealed surface 38 of the cylinder head 20. Therefore, the oil grooves 36, 37 are securely sealed by the contact between the sealed surface 38 and the peripheral surface of the journal 34 regardless of the relatively wide width a of the oil grooves 36, 37. This prevents oil leakage from between the journal 34 and the cylinder head 20.

Furthermore, the slight clearance C between the sealed surface 39 of the bearing cap 35 and the journal 34 allows a small amount of oil to leak from the oil grooves 70, 71. The oil lubricates the journal 34 and enables smooth rotation of the journal 34. Since the width b of the oil grooves 70, 71 is narrower than the width a of the oil grooves 36, 37, the area of the sealed surface 39 is greater than that of the sealed surface 38. Furthermore, the increased contact area between the journal 34 and the sealed surface 39 improves the sealing of the oil grooves 70, 71 regardless of the clearance C existing between the journal 34 and the sealed surface 39. This suppresses the flow of oil to and from the third and fourth oil grooves 70, 71. Thus, the hydraulic pressure in the oil grooves 70, 71 are not affected by each other. The enhanced sealing of the oil grooves 70, 71 also reduces the amount of oil that leaks externally from the journal 34.

The width "b" of the oil grooves 70, 71 is relatively narrow. However, the width a of the oil grooves 36, 37 is relatively wide. This structure guarantees that the required amount of oil will occupy in the associated first and third oil grooves 36, 70 and in the associated second and fourth oil grooves 37, 71.

As described above, the improved sealing and the guaranteed amount of oil in the oil grooves 36, 37, 70, 71 enable the pressure chambers 58, 59 to receive the desirable hydraulic pressure. This improves the responsiveness of the VVT 11. Furthermore, the enlarged contact area between the bearing cap 35 and the journal 34 eliminates the necessity to lengthen the journal 34. Thus, the length of the engine 13 need not be increased.

The circumferential location of the oil grooves 36, 37 may be altered in accordance with the direction of the load acting on the camshaft 17. In such a case, the oil grooves 36, 37 are to be axially aligned with the oil associated grooves 70, 71.

Second Embodiment

A second embodiment of a variable valve timing mechanism according to the present invention will now be described with reference to FIGS. 5 and 6.

To avoid a redundant description, like or same reference numerals are given to those components that are like or same as the corresponding components of the first embodiment.

Figure 5:
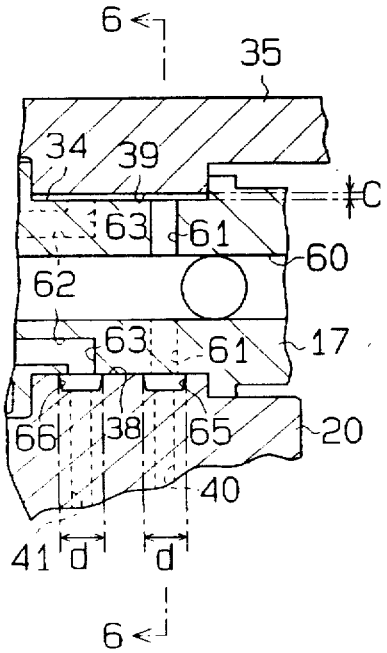
FIG. 5 is a partial enlarged cross-sectional view showing a second embodiment of a variable valve timing mechanism according to the present invention.
Figure 6:
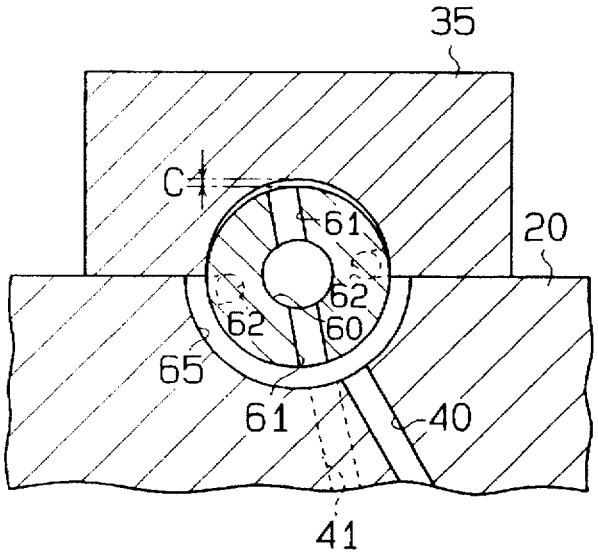
FIG. 6 is a partial cross-sectional view taken along line 6—6 in FIG. 5.

As shown in FIGS. 5 and 6, the VVT 11 has a pair of first oil holes 61, a pair of second oil passages 62, and a pair of third oil holes 63. Although first and second oil grooves 65, 66 are defined in the sealed surface 38 of the cylinder head 20, oil grooves are not provided in the sealed surface 39 of the bearing cap 35. In other words, the oil grooves 65, 66 in the cylinder head 20 are provided for half the circumference of the journal 34. In this embodiment, the oil grooves 65, 66 have a width "d" that is about twice as wide as the width "a" of the oil grooves 36, 37 of the first embodiment. This enables the same amount of oil flow obtained through the oil grooves 36, 37, 70, 71 of the first embodiment to be obtained in this embodiment.

The pair of first oil holes 61 are symmetrical with respect to a plane bisecting the camshaft 17 along its axis and extend radially from the first oil passage 60 in the camshaft 17. The pairs of second oil passages 62 and the third oil holes 63 in the camshaft 17 are also symmetrical with respect to a plane bisecting the camshaft 17 along its axis. Each second oil passage 62 extends axially along the camshaft 17. Each third oil hole 63 extends radially from one of the second oil passages 62. Accordingly, one or the other of the first oil holes 61 is always communicated with the first oil groove 65 while one or the other of the third oil holes 63 is always communicated with the second oil groove 66 despite the fact that the oil grooves 65, 66 do not surround the camshaft 17. This structure allows hydraulic fluid to be positively conveyed from the oil grooves 65, 66 to the pressure chambers 58, 59.

In the same manner as the first embodiment, the tension of the belt 27 pulls the camshaft 17 toward the crankshaft 21. This produces a force that is received by the cylinder head 20. Accordingly, the journal 34 is pressed against the sealed surface 38 of the cylinder head 20. This ensures the sealing of the oil grooves 65, 66.

Since oil grooves are not provided in the sealed surface 39, the area of the sealed surface 39 is greater than that of the sealed surface 38. This enhances the sealing effect between the journal 34 and the bearing cap 35. Accordingly, the amount of oil from the oil grooves 65, 66 that leaks out of the journal 34 is reduced.

As described above, the structure of this embodiment improves sealing of the oil grooves 65, 66 and guarantees the appropriate flow of oil that is to be supplied to the oil grooves 65, 66. This conveys the desired amount of hydraulic oil to the first and second pressure chambers 58, 59 and improves the responsiveness of the VVT 11. Forming the oil grooves 65, 66 solely in the sealed surface 38 and not in the sealed surface 39 enlarges the contact area between the sealed surface 39 and the journal 34. Accordingly, since the length of the journal 34 does not need to be increased, it is not necessary to increase the length of the engine 13. Furthermore, the structure of this embodiment enables the journal 34 to be shortened since the sealed surface 39 does not have oil grooves. That is, the length of the camshaft 17 may be shortened, which contributes to production of a more compact engine.

In this embodiment, the structure of the bearing cap 35 may be simplified since the sealed surface 39 does not have oil grooves.

The circumferential location of the oil grooves 65, 66 may be altered in accordance with the direction of the load acting on the camshaft 17.

Although only two embodiments of the present invention have been described herein, it should be apparent to those skilled in the art that the present invention may be embodied in many other specific forms without departing from the spirit or scope of the invention. Particularly, it should be understood that the present invention may be embodied in the following forms.

In the illustrated embodiments, the number of the oil holes 61, 63 that are connected with the oil grooves 36, 37, 65, 66 is either one or two. However, three or more oil holes 61, 63 may be provided in the camshaft 17.

The width of the oil grooves 36, 37, 65, 66, 70, 71 may be altered as desired as long as the required sealing and the required amount of oil flow is guaranteed.

Figure 7:
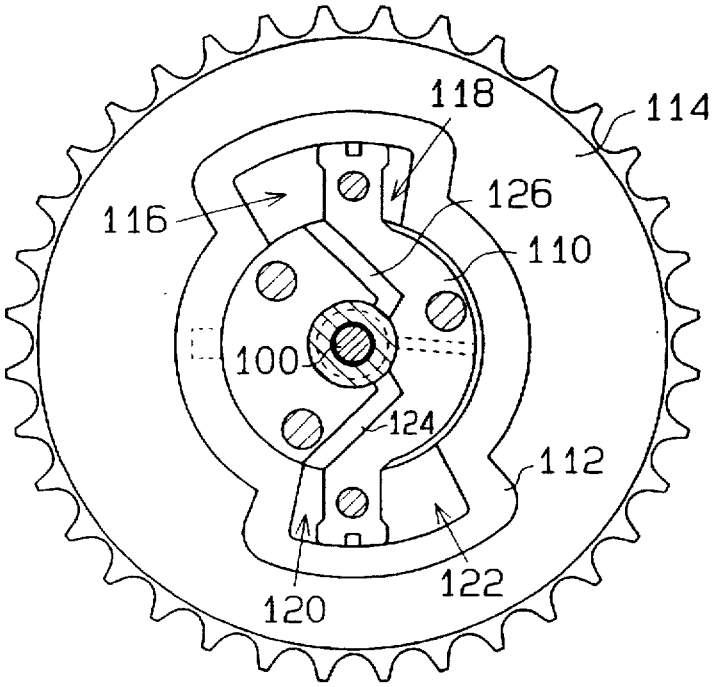
FIG. 7 is front view showing another embodiment of the present invention.
Figure 8:
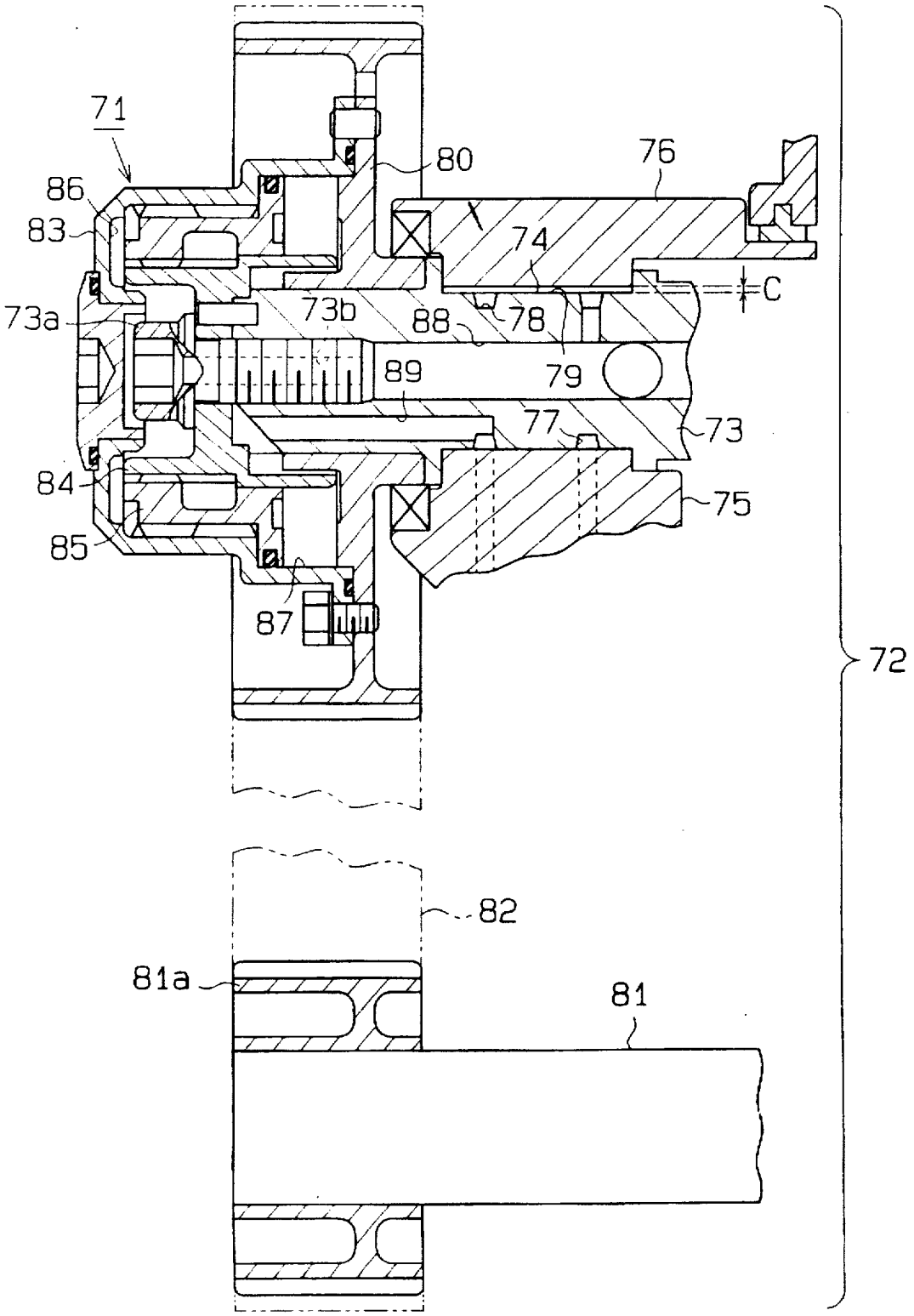
Fig.8 (PRIOR ART)
FIG. 8 is a cross-sectional view showing a prior art variable valve timing mechanism.

The present invention may be applied to other types of VVT as long as the camshaft constantly receives load acting in a certain direction. For example, the present invention may be applied to a vane type VVT such as that described in U.S. Pat. No. 5,107,804, which is incorporated herein by reference. As shown in FIG. 7, this VVT is secured to the distal end of a camshaft 100. The VVT includes a rotor 110 having a vane serving as an actuating member, a housing 112 encompassing the rotor 110, and a sprocket 114. The sprocket 114 and the housing 112 are formed integrally and are relatively rotatable with respect to the camshaft 100 and the rotor 110. The VVT further includes hydraulic pressure chambers 116, 118, 120, 122 on each side of the vane. The pressure chambers 116, 118, 120, 122 are partitioned from one another by the vane and the housing 112. Hydraulic pressure is conveyed to the pressure chambers 120, 116 through oil passages 124, 126, respectively. The sprocket 114 is connected to a crankshaft (not shown) by a timing chain (not shown). In this VVT, the tension of the chain produces load that acts on the camshaft 100 in a certain direction.

In the above embodiments, sprockets may be used in lieu of the pulleys 24, 25, 26 and a chain may be used in lieu of the belt 27.

Therefore, the present examples and embodiments are to be considered as illustrative and not restrictive and the invention is not to be limited to the details given herein, but may be modified within the scope of the appended claims.

What is claimed is:

1. An apparatus for adjusting the valve timing of a valve of an engine, the apparatus comprising:

a crankshaft;

a camshaft for actuating said valve, the camshaft having a journal;

a bearing for rotatably supporting said camshaft, the bearing having an inner cylindrical surface;

a rotor mounted on said camshaft, the rotor being rotatable relative to the camshaft;

a transmission means for connecting said rotor to the said crankshaft to transmit power from the engine to the rotor, wherein the transmission means applies a force to the rotor and the camshaft in a specific direction, and wherein as a result of a net force on said camshaft, a portion of said cylindrical surface is load bearing and an opposite portion of said cylindrical surface is non-load bearing;

an actuating member for changing the relative rotational relationship between said camshaft and said rotor;

a first pressure chamber for applying a hydraulic fluid pressure to said actuating member to move said actuating member in a first direction;

a second pressure chamber for applying a hydraulic fluid pressure to said actuating member to move said actuating member in a second direction;

a first passage defined in said camshaft, the first passage being connected to said first pressure chamber;

a second passage defined in said camshaft, the second passage being connected to said second pressure chamber;

a first groove formed in the inner cylindrical surface of said bearing, the first groove being connected to said first passage; and a second groove formed in the inner cylindrical surface of said bearing, the second groove being connected to said second passage; and wherein the first and second grooves each form an arc about the camshaft without surrounding the camshaft, and wherein the first and second grooves extend along the load bearing portion of the cylindrical surface.

2. The apparatus as set forth in claim 1, wherein said first passage is connected to said first groove, and there are at least two connecting passages between the first passage and the first groove, and wherein said second passage connects to said second groove, and there are at least two connecting passages between the second passage and the second groove.

3. The apparatus as set forth in claim 2, wherein said journal substantially seals said first and second grooves by contact with said bearing.

4. The apparatus as set forth in claim 3, wherein said specific direction is along a line connecting said camshaft and said crankshaft.

* * * * *